US008613596B2

(12) United States Patent
Fritsch

(10) Patent No.: US 8,613,596 B2
(45) Date of Patent: Dec. 24, 2013

(54) VANE ASSEMBLY HAVING A VANE END SEAL

(75) Inventor: Theodore J. Fritsch, Indianapolis, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 751 days.

(21) Appl. No.: 12/885,524

(22) Filed: Sep. 19, 2010

(65) Prior Publication Data

US 2011/0158793 A1 Jun. 30, 2011

Related U.S. Application Data

(60) Provisional application No. 61/290,431, filed on Dec. 28, 2009.

(51) Int. Cl.
*F01D 5/20* (2006.01)

(52) U.S. Cl.
USPC ..... 416/87; 415/170.1; 415/173.2

(58) Field of Classification Search
USPC ..... 415/155, 159, 160, 170.1, 173.1, 173.2, 415/173.3, 174.4; 416/87, 142, 143; 277/306, 358
See application file for complete search history.

(56) References Cited

U.S. PATENT DOCUMENTS 3,117,716 A * 1/1964 Wernicke ..... 415/140
3,854,842 A 12/1974 Caudill
4,193,738 A 3/1980 Landis, Jr. et al.
5,165,859 A 11/1992 Monroe
6,206,642 B1 3/2001 Matheny et al.
6,634,860 B2 10/2003 Lee et al.
6,755,619 B1 6/2004 Grylls et al.
6,948,205 B2 9/2005 Van Der Wurf et al.
6,966,755 B2 * 11/2005 Garner ..... 416/87
2004/0146404 A1 7/2004 Chantal et al.
2008/0110101 A1 5/2008 Gross et al.
2009/0087334 A1 4/2009 Whitesell

OTHER PUBLICATIONS

International Search Report and Written Opinion, PCT/US10/62181, Mar. 13, 2012, Rolls-Royce Corporation.

* cited by examiner

*Primary Examiner* — Edward Look
*Assistant Examiner* — Aaron R Eastman
(74) *Attorney, Agent, or Firm* — Krieg DeVault LLP

(57) ABSTRACT

One embodiment of the present invention is a unique turbomachinery device, a non-limiting example of which is a gas turbine engine. Another embodiment is a unique vane assembly for a turbomachinery device. Another embodiment is a unique seal assembly for a vane of a turbomachinery device. Other embodiments include apparatuses, systems, devices, hardware, methods, and combinations for turbomachinery devices, and for vane assemblies and seal assemblies for turbomachinery devices. Further embodiments, forms, features, aspects, benefits, and advantages of the present application shall become apparent from the description and figures provided herewith.

25 Claims, 6 Drawing Sheets

VANE ASSEMBLY HAVING A VANE END SEAL

CROSS REFERENCE TO RELATED APPLICATIONS

The present application claims the benefit of U.S. Provisional Patent Application 61/290,431, filed Dec. 28, 2009, and is incorporated herein by reference.

FIELD OF THE INVENTION

The present invention relates to turbomachinery, and, more particularly, to a rotatable vane having a self adjusting seal configured to seal the gap between an end of the vane and the surface of an adjacent structure.

BACKGROUND

Gas turbine engines, gas turbine engine vane assemblies, and the sealing of rotatable gas turbine engine vanes, remain an area of interest. Some existing systems have various shortcomings, drawbacks, and disadvantages relative to certain applications. Accordingly, there remains a need for further contributions in this area of technology.

SUMMARY

One embodiment of the present invention is a unique turbomachinery device, a non-limiting example of which is a gas turbine engine. Another embodiment is a unique vane assembly for a turbomachinery device. Another embodiment is a unique seal assembly for a vane of a turbomachinery device. Other embodiments include apparatuses, systems, devices, hardware, methods, and combinations for turbomachinery devices, and for vane assemblies and seal assemblies for turbomachinery devices. Further embodiments, forms, features, aspects, benefits, and advantages of the present application shall become apparent from the description and figures provided herewith.

DETAILED DESCRIPTION

Figure 1:
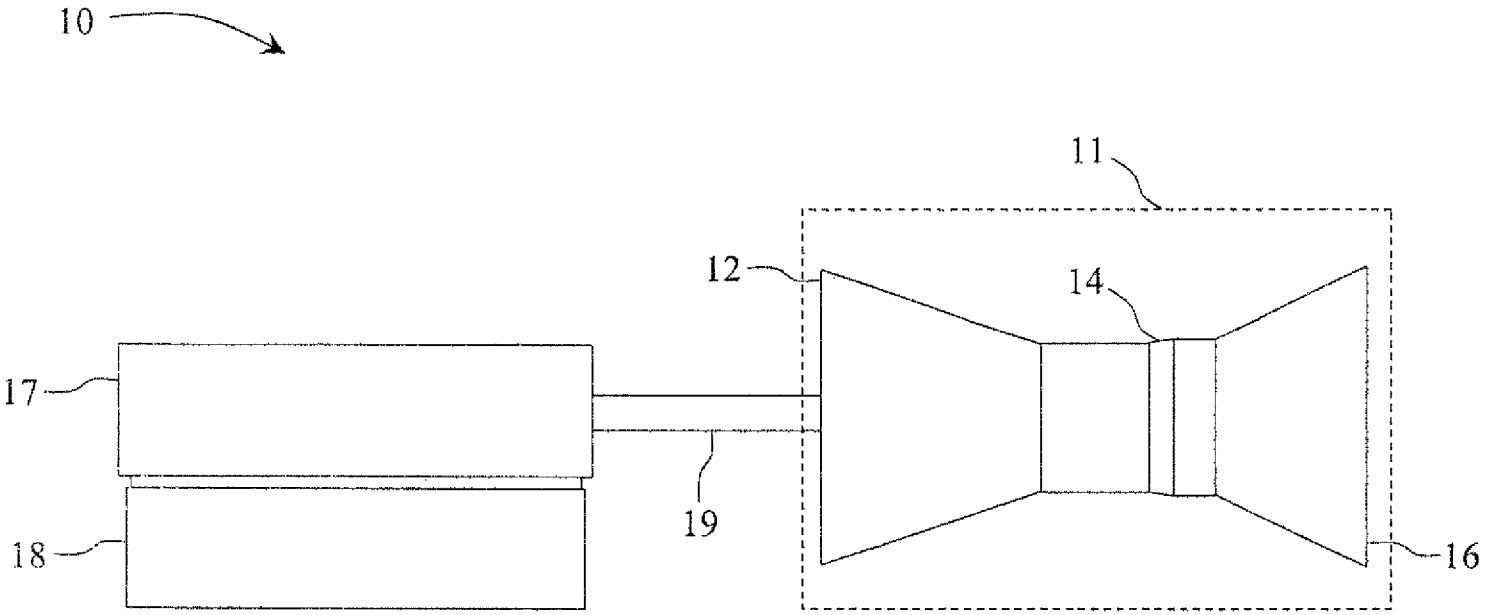
FIG. 1 schematically depicts a non-limiting example of a turbomachinery device in accordance with an embodiment of the present invention.

For purposes of promoting an understanding of the principles of the invention, reference will now be made to the embodiments illustrated in the drawings, and specific language will be used to describe the same. It will nonetheless be understood that no limitation of the scope of the invention is intended by the illustration and description of certain embodiments of the invention. In addition, any alterations and/or modifications of the illustrated and/or described embodiment(s) are contemplated as being within the scope of the present invention. Further, any other applications of the principles of the invention, as illustrated and/or described herein, as would normally occur to one skilled in the art to which the invention pertains, are contemplated as being within the scope of the present invention.

The present invention was developed for application in the field of turbomachinery, including, but not limited to, gas turbine engines, steam turbine engines, other turbines and compressors, engine-driven fans, variable nozzles, and thrust vectoring devices, etc., that employ rotatable vanes, i.e., vanes that rotate in order to modify the flow of the working fluid, including the flow quantity and/or flow direction. As used herein, it will be understood that the term, "rotatable vane," pertains to a vane that may be rotated about an axis that extends approximately in the span-wise direction of the vane but is otherwise stationary, as opposed to blades, e.g., compressor and/or turbine blades, which continually rotate about an axis that is approximately perpendicular to the span-wise direction of the blade.

The output of a turbomachinery device can be enhanced and/or controlled by incorporating one or more stages of rotatable vanes, such as, for example, variable area fan, compressor, turbine and/or vanebox nozzle vanes, which can be rotated in a controlled manner to modify the flow of the working fluid during operation of the turbomachinery device. Rotatable vanes are disposed in proximity with and move relative to adjacent structures, such as flowpath walls, and may rotate between minimum and maximum flow positions to regulate flow of the working fluid. In order to prevent undesirable contact between the adjacent structures and the end portions of the vane, e.g., vane tips and/or roots, a gap is typically provided between the vane tip and adjacent structure, and between the vane root and adjacent structure. However, such gaps yield undesirable "end wall leakage" of the working fluid past the vane, which reduces the performance of the turbomachinery device. In addition, rotation of the vane may result in increased gap widths, depending upon the angle of rotation of the vane and the surface geometry of the adjacent structures, which may increase the undesirable leakage of the working fluid. Since turbomachinery efficiency and the precision of turbomachinery control decrease with increasing vane end wall leakage, it is desirable to minimize or eliminate end wall leakage.

Referring now to FIG. 1, there is illustrated a generic representation of a turbomachinery device 10. This non-limiting depiction of turbomachinery device 10 may include various components, including a gas turbine engine 11, which may itself include a compressor section 12, a combustor section 14 and a turbine section 16. Turbomachinery device 10 may also include a lift fan 17 and a vanebox 18. Each of gas turbine engine 11, compressor section 12, combustor section 14, turbine section 16, lift fan 17 and vanebox 18 are considered turbomachinery devices, individually and in combination, any or all of which may employ one or more vane assemblies and vane end seals in accordance with embodiments of the present invention, non-limiting examples of which are described herein. It will be noted that other turbomachinery devices, e.g., steam turbines and pumps, may also employ one or more vane assemblies and vane end seals in accordance with embodiments of the present invention.

Compressor section 12 includes one or more compressor stages (not shown), and in some embodiments may include one or more fan stages. Turbine section 16 includes one or more turbine stages (not shown). Turbine section 16 may be coupled to compressor section 12 via one or more shafts (not shown), and may provide power to compressor section 12. Turbine section 16 may also be arranged to provide power for other components (not shown). In the present embodiment, power may be supplied from gas turbine engine 11 to lift fan 17 via a shaft system 19. Lift fan 17 discharges air to provide thrust, e.g., for a short take-off vertical landing (STOVL) aircraft, which is passed through vanebox 18. Vanebox 18 includes a plurality of airfoils in the form of rotatable vanes that may be rotated in a controlled manner by a mechanism (not shown) in order to control the amount and/or direction of thrust output by lift fan 17 in response to the aircraft pilot's control input.

Although the present invention is described herein with respect to rotatable vanes of vanebox 18, it will be understood that the present invention is equally applicable to rotating vanes in other turbomachinery components, such as fans employed in turbofan engines, as well as lift fans, compressors, turbines, etc., and that the present invention is not limited to use in thrust control and/or vectoring devices, such as vanebox 18.

Figure 2:
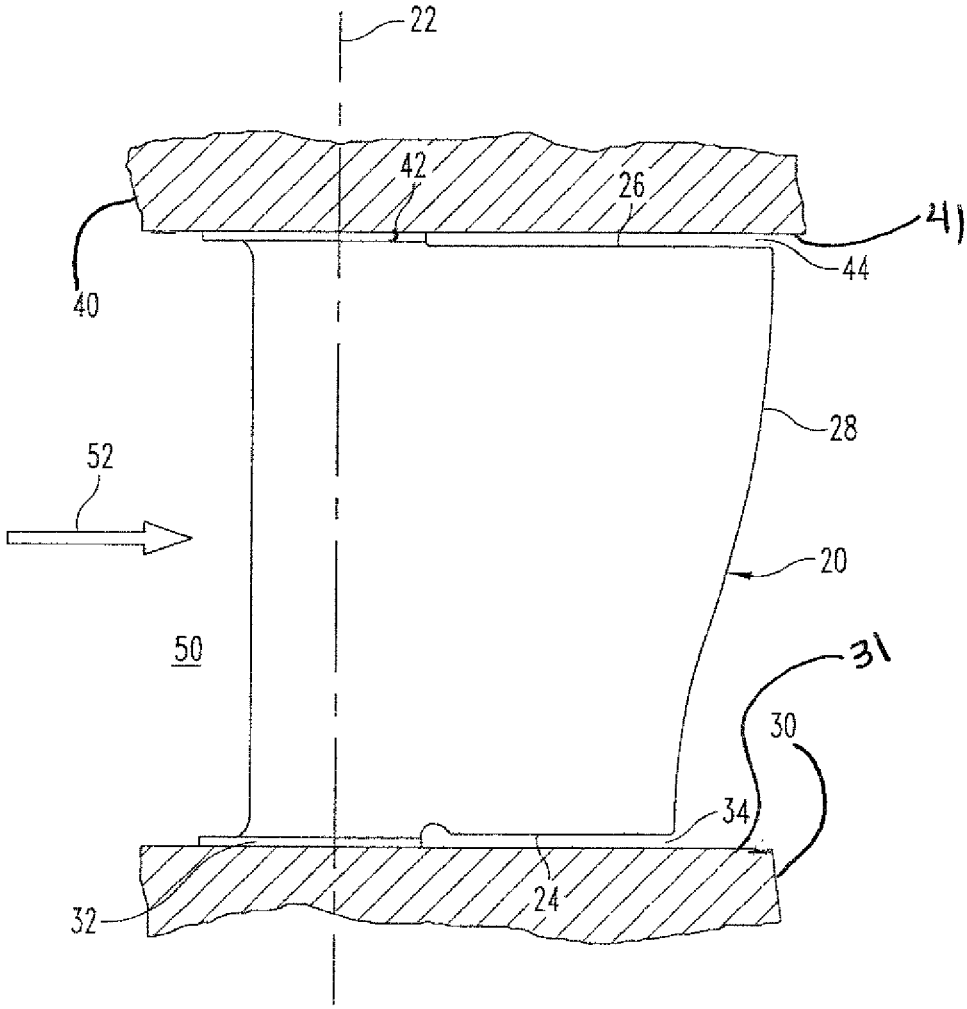
FIG. 2 is a partial cross sectional side elevation view depicting a vane positioned adjacent surrounding structures.

Referring now to FIG. 2, a rotatable vane of vanebox 18, identified herein as rotatable vane 20, is depicted between two flow path defining structures, adjacent structures 30 and 40 (shown in cross section), that define therebetween a gas flow path 50. Vane 20 includes end sections 24 and 26 that are adjacent to surfaces 31 and 41 of adjacent structures 30 and 40, respectively. Each vane 20 may be configured to control the flow of the working fluid in turbomachinery device 10, which in the present embodiment is the discharge air from lift fan 17. The flow direction of the working fluid through flow path 50 is indicated by a direction arrow 52. Structures 30 and 40 may be, for example and without limitation, walls, shrouds, stators, rotors or the like, all of which are referred to generally herein as "surrounding structure" or "adjacent structure." Vane 20 is pivotable about an axis 22 that may extend approximately in the span-wise direction of vane 20. In the present embodiment, this rotatability allows vanes 20 to control the flow path area of flow path 50, and to control thrust output and direction. In one form, vane 20 is supported by adjacent structure 40 via a supporting member 42, and is supported by adjacent structure 30 via a supporting member 32. In other embodiments, other means of supporting vane 20 may be employed.

It is desirable that each vane 20 be free to rotate about axis 22 in a controlled manner (control mechanism not shown) and without binding, and hence, end sections 24 and 26 of each vane are 20 configured to be spaced apart from oppositely adjacent surfaces 31 and 41, respectively, a sufficient distance to prevent contact between end sections 24, 26 and adjacent surfaces 31 and 41 during rotation of vane 20, i.e., as vane 20 pivots about axis 22 and end sections 24 and 26 accordingly move in relation to adjacent surfaces 31 and 41 of adjacent structures 30 and 40. The distance is depicted as gaps 34 and 44 between end sections 24 and 26 and adjacent surfaces 31 and 41, respectively.

It is preferable to minimize end wall leakage of working fluid, as discussed above, and thus it is desirable to prevent or reduce flow through gaps 34 and 44 between vane end sections 24 and 26 and structures 30 and 40. However, decreasing the widths of the gaps 34 and 44 may be problematic for various reasons, such as thermal expansion, build tolerances, deflections of vanebox 18 components occurring due to internally and external imposed loads, e.g., pressure differentials and aircraft maneuvering loads, respectively, which may dictate a minimum non-zero gap width between vane end sections 24, 26 and structures 30, 40. In addition, the axis 22 of rotation of rotatable vane 20 may not be perfectly perpendicular to surfaces 31 and 41, and the geometry of surfaces 31 and 41 may vary, thereby causing variations in the gap width as vane 20 is rotated. Thus, minimizing the gap in one position might leave a significantly larger gap when vane 20 is rotated to a different position, or might cause an end of vane 20 to contact an adjacent structure and prevent further movement the vane. Also, the surfaces of adjacent structures may not be planar or uniform, resulting in a similar problem.

The sealing of gaps 34 and 44 to reduce or prevent leakage between end sections 24 and 26 of vane 20 and walls 30 and 40, respectively, may be accomplished by virtue of vane end seals in accordance with embodiments of the present invention, described herein. Because the manner of vane end sealing is accomplished according to the same general principles at both end sections 24 and 26 of vane 20, attention will be directed with particular reference to the sealing of vane end section 24 that is proximate to flow path defining wall 30. It will be understood that similar seals may be utilized in connection with opposite vane end section 26, with other vane ends of vanes having differing dimensions and features, and that more than one such inventive seal assembly may be employed for each vane end section without departing from the scope of the present invention.

Figure 3:
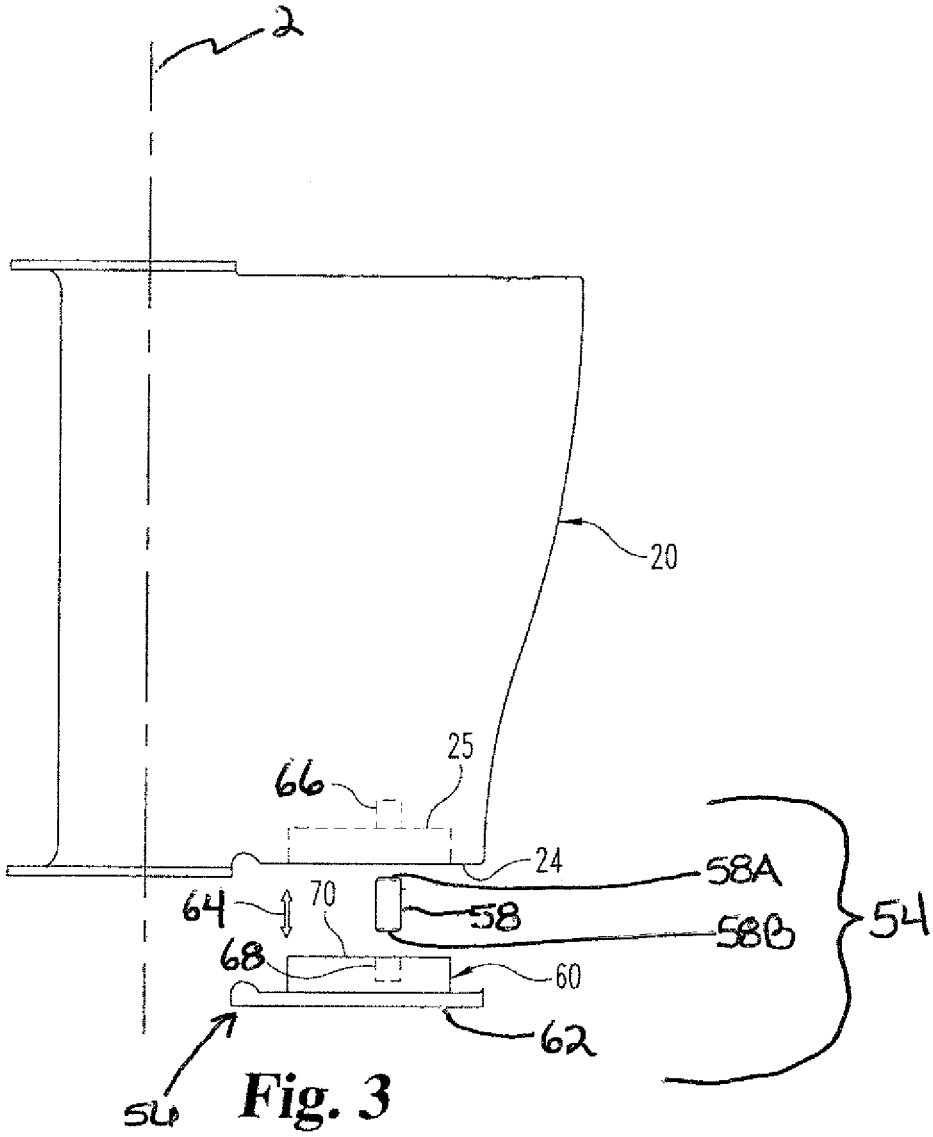
FIG. 3 is an illustrative side elevation view of a non-limiting example of a rotatable vane with a vane end seal assembly in accordance with an embodiment of the present invention, shown in an exploded (uninstalled) view.

Referring now to FIG. 3, a vane end seal assembly 54 is depicted along with vane 20. Seal assembly 54 includes a seal 56 and a biasing member 58 configured to urge sealing portion 62 in a direction toward surface 31. Biasing member 58 has a first end 58A and a second end 58B. Seal 56 is configured to seal gap 34 between vane end section 24 and surface 31 of adjacent structure 30. Seal 56 includes a body 60 with a sealing portion 62. Sealing portion 62 is configured to seal against the surface of the adjacent structure, e.g., surface 31. In one form, sealing portion 62 is an extension of body 60 and shares the same profile therewith. Alternatively, it is contemplated that sealing portion 62 may have a larger or smaller "footprint" than body 60, e.g., have greater or lesser dimensions than body 60 as measured in a plane approximately perpendicular to axis 22. Vane end section 24 includes a seal guide feature 25. In one form, seal guide feature 25 is a cavity in vane end section 24 that faces surface 31. In other embodiments, seal guide feature 25 may take other forms.

Seal guide feature 25 is configured to position seal 56 at a desired location in vane 20 in a plane approximately perpendicular to axis 22. Seal guide feature 25 is also configured as a piloting feature to pilot body 60, i.e., to guide seal 56 during translation of seal 56 in and out of vane end section 24, e.g., in a direction 64, such as might occur during the installation and removal of seal 56, and/or as might occur due to contact with surface 31 of adjacent structure 30 during the rotation of vane 20. In the present embodiment, direction 64 is parallel to axis 22, although the present invention is not so limited.

In one form, seal guide feature 25 includes a piloting feature 66 that is configured to pilot one end of biasing member 58, e.g., end 58A. In the present embodiment, piloting feature 66 takes the form of a counterbore extending from seal guide feature 25 into vane 20. In other embodiments, piloting feature 66 may take other forms. Still other embodiments may not include a piloting feature such as piloting feature 66 as part of the seal guide feature. In one form, seal body 60 also includes a piloting feature 68 configured to receive and pilot another end of biasing member 58, e.g., end 58B. In the present embodiment, piloting feature 68 is in the form of a counterbore extending into body 60, although other forms may be employed in other embodiments. Still other embodiments may not include a piloting feature such as piloting feature 68 as part of the body.

The profile of body 60 may be contoured to match the profile of seal guide feature 25, and is slidably received by seal guide feature 25. The profile of sealing portion 62 may be contoured to match the profile of vane 20 at the location of end section 24.

As represented herein, biasing member 58 may be in the form of a compression spring. However, a person of ordinary skill in the art will appreciate that alternative types of biasing members may be employed in other embodiments. For example, a torsional coil spring, a cantilever beam spring, a leaf spring and/or other suitable biasing devices may be employed in other embodiments of the present invention.

Biasing member 58 is received by seal guide feature 25, and once vane 20 is installed into vanebox 18, biases sealing portion 62 of seal body 60 against surface 31, to thereby seal gap 34 (illustrated in FIG. 2). In one form, body 60 and sealing portion 62 are formed of a low friction polymer, e.g., may be made from a low friction polymer. In other embodiments, body 60 and sealing portion 62 may include a low friction polymer surface treatment, in order to reduce wear and reduce the load on the mechanism that rotates vane 20. In still other embodiments, a low friction material may not be employed on body 60 and/or sealing portion 62. Examples of commercially available polymers suitable for the relatively low temperatures that may be encountered in vanebox 18, lift fan 17 and a fan and low pressure compressor stages of compressor section 12, may include VESPEL® and TEFLON® by DUPONT™, and TORLON® by Solvay Advanced Polymers.

Figure 4:
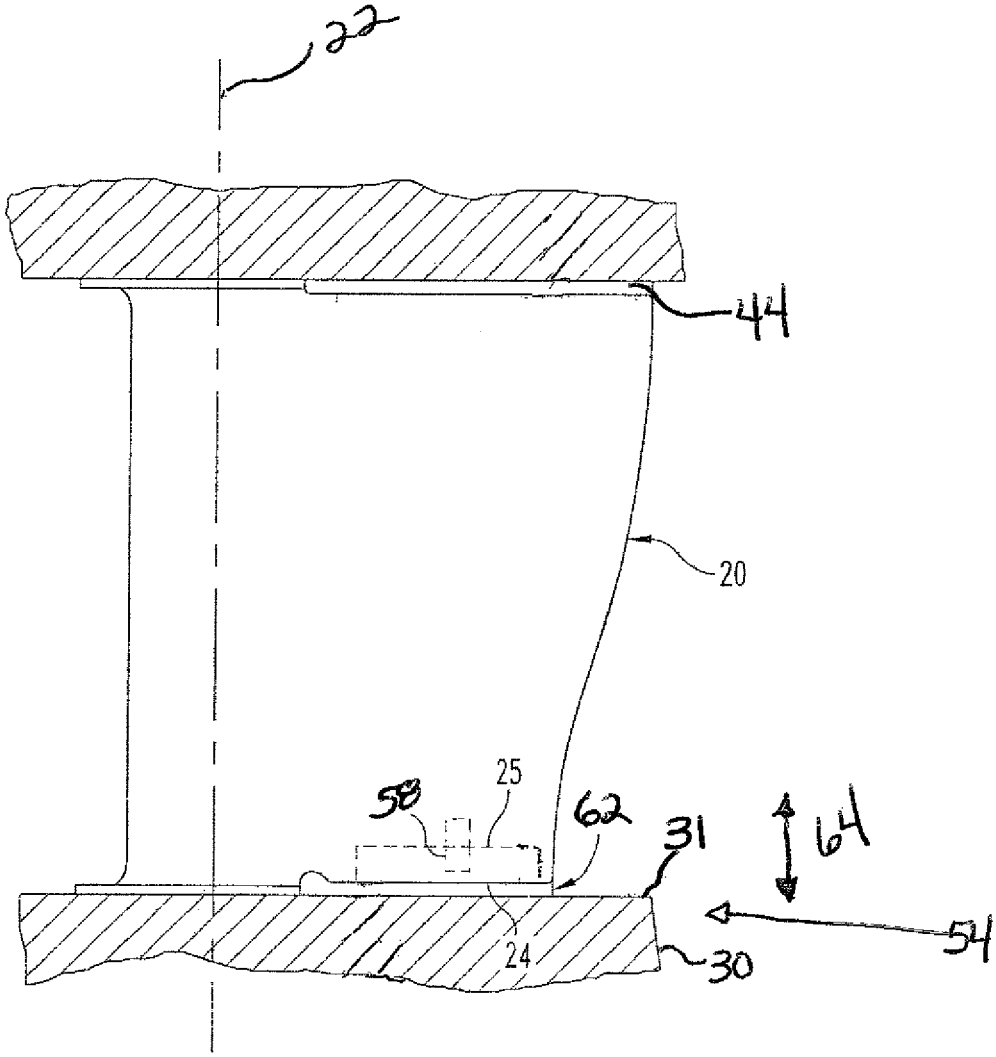
FIG. 4 is a partial cross sectional side elevation view depicting the vane and end seal assembly of FIG. 3 in the installed condition.

Referring now to FIG. 4, vane 20 is depicted with seal assembly 54 installed. Gap 34 is not depicted in FIG. 4 because its width has been filled by seal 56. It is noted that, for purposes of illustration, FIG. 4 does not depict a vane end seal for end section 26, and hence, gap 44 is present. However, it will be understood, as set forth above, that a vane end seal for vane end section 26 may be similarly be provided in accordance with the description of vane end seal assembly 54.

During the operation of vanebox 18, biasing member 58 urges sealing portion 62 against surface 31 of adjacent structure 30, which may seal the gap and thereby reduce leakage between vane end section 24 and adjacent structure 30. In addition, in the event wear occurs due to the rotation of vane 20, e.g., abrasive wear of sealing portion 62 due to moving contact with surface 31, biasing member 58 continues to urge seal 56 in the direction of surface 31 (the direction may be governed by seal guide feature 25) thereby compensating for the material worn off of sealing portion 62.

Figure 5:
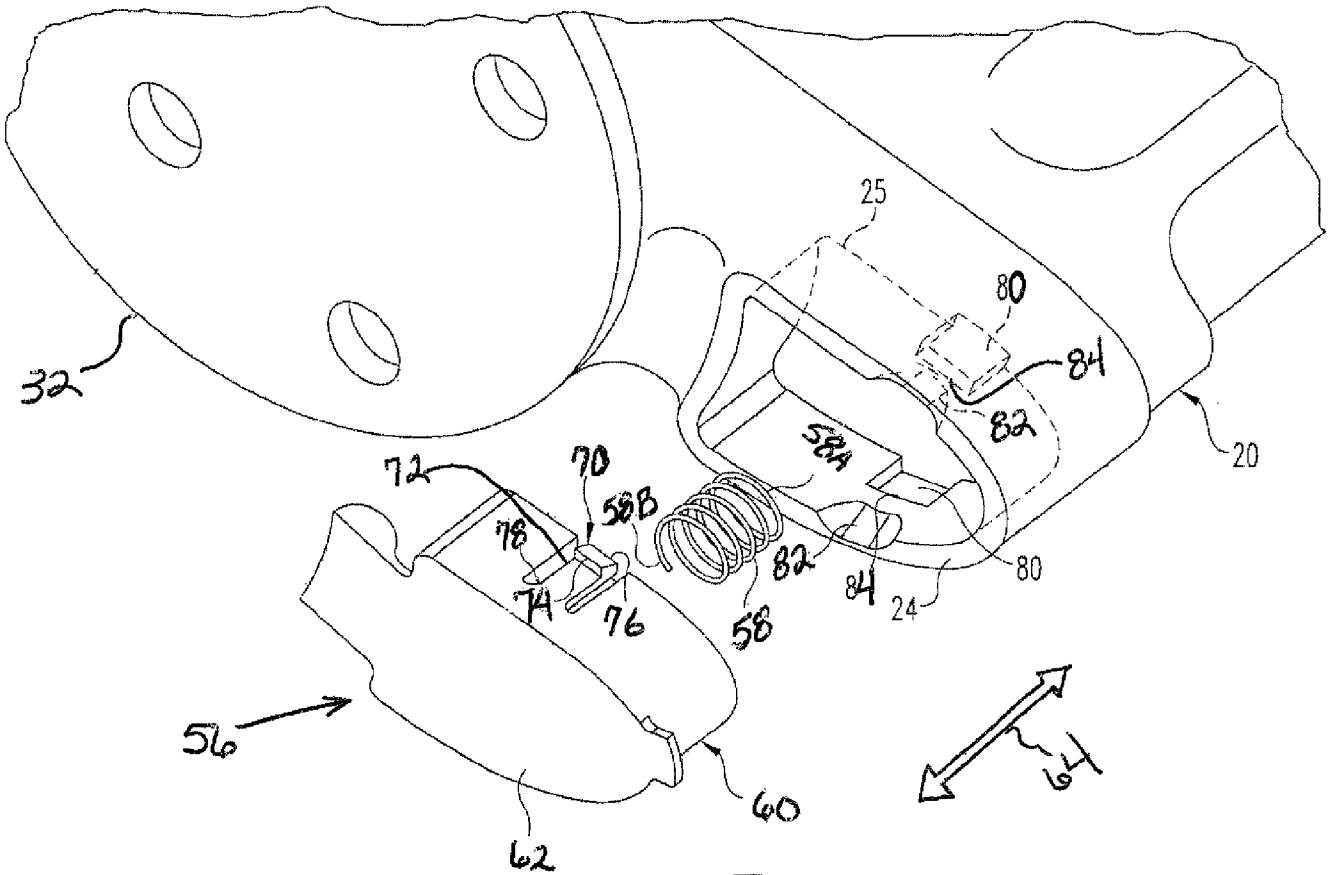
FIG. 5 depicts an exploded perspective view of a non-limiting example of an embodiment of the present invention that includes a seal retention feature.
Figure 6:
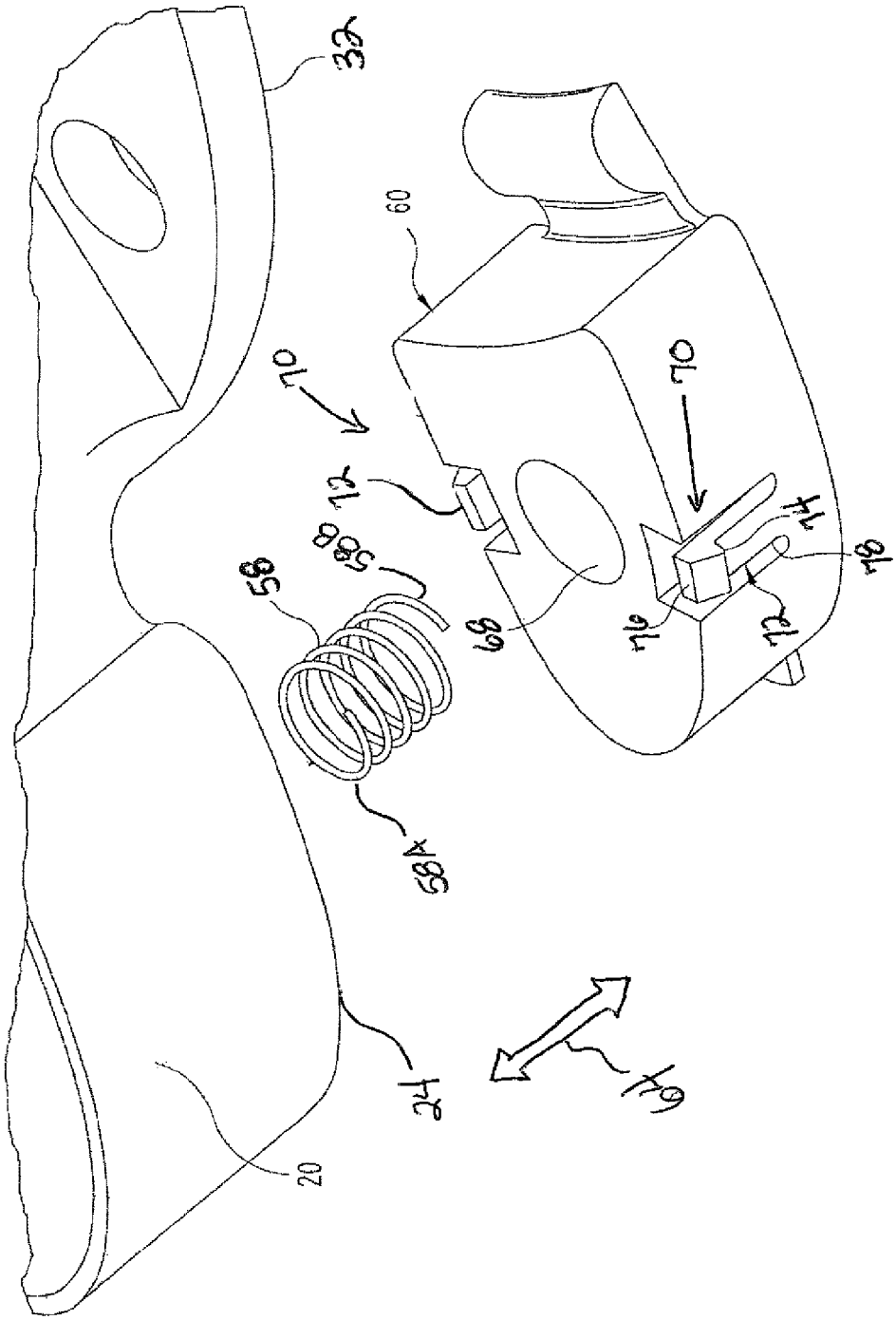
FIG. 6 depicts another exploded perspective view of the embodiment of FIG. 5.

Referring now to FIGS. 5 and 6, a modification of the embodiment of FIGS. 3 and 4 is depicted. In the embodiment depicted in FIGS. 5 and 6, seal body 60 may include one or more of a retention feature 70 that operates to prevent body 60 of seal 56 from completely exiting seal guide feature 25 until disengagement is desired, e.g., releasably retaining body 60 with seal guide feature 25. The depiction of FIGS. 5 and 6 includes two retention features 70, although a greater or lesser number of retention features may be employed in other embodiments. Still other embodiments may not include any such retention feature.

In one form, retention feature 70 includes a cantilevered arm 72. Cantilevered arm 72 includes a catch feature 74 at an end 76, and is attached to body 60 at an end 78. In one form, retention feature 70 is formed as part of body 60, although in other embodiments, retention feature 70 may be formed separately from body 60 and attached thereto. In one form embodiment, cantilevered arm 72 is made from an elastic material that allows cantilevered arm 72 to deflect during the installation of seal 56 into vane 20, and to snap back to a substantially undeflected position.

In one form, seal guide feature 25 includes a recess 80 and ramp 82 for each retention feature 70. Recess 80 is configured to receive catch feature 74, and catch feature 74 is configured for movement in recess 80, e.g., in direction 64. Recess 80 defines a clamping shoulder 84 that is positioned to engage catch feature 74 to thereby limit the extent of outward movement of body 60 from seal guide feature 25 beyond a predetermined limit.

Retention feature 70 may allow substantially unimpeded bidirectional movement of seal body 60 in direction 64 over a predetermined distance that may be selected as providing a range of motion for seal body 60 sufficient to allow sealing portion 62 to remain in contact with surface 31 of structure 30 by action of biasing member 58 as the width of gap 34 changes during normal rotation of vane 20. In addition, the predetermined distance may also be selected to allow body 60 to extend from vane end 24 to compensate for wear at the surface of sealing portion 62 and/or surface 31 of adjacent structure 30. Retention feature 70 thus provides a mechanism whereby seal body 60 may be removably attached to vane 20 during the assembly of vanebox 18 by directing body 60 into the cavity defining seal guide feature 25 until catch feature 74 clears clamping shoulder 84.

During the installation of seal 56 into vane 20, seal 56 is engaged with seal guide feature 25, e.g., in the present embodiment, by directing seal body 60 (end 76 of each cantilevered arm 72 first) into the cavity defining seal guide feature 25. During the insertion of seal 56 into vane end section 24, ramp 82 may aid installation by smoothly "ramping up" the deflection of end 76 of cantilevered arm 72 in order clear shoulder 84. Once catch feature 74 has cleared clamping shoulder 84, cantilevered arm 72 returns substantially to it's original, undeflected position (e.g., minus a small amount of hysteresis), thereby creating an interference between catch feature 74 and clamping shoulder 84, which retains catch feature 74 in recess 80, thereby retaining seal 56 in vane end section 24. Retention feature 70 holds seal 56 in place after vane 20 is removed from structures 30 and 40, for example, during disassembly of vanebox 18 for repairs or for other reason.

Although a particular embodiment of retention feature 70 has been described herein, one skilled in the art would appreciate that retention feature 70 may take other forms in other embodiments. For example, retention feature 70 may be one of many latch configurations that take a positive locking approach or a passive locking approach. A positive latching approach may require that some portion of the device be manually pressed to disengage seal body 60 from seal guide feature 25, whereas a passive latching approach may allow disengagement of seal body 60 from seal guide feature 25 by simply exerting a sufficient separating force upon the seal 60 to disengage the latch.

In one form, retention feature 70 employs a positive latching design, and may be removed by directing a tool, such as a rod (not shown), between body 60 and seal guide feature 25 at the location of ramp 82, and forcing the rod in the direction of catch feature 74. As the rod is moved toward catch feature 74, it may employ ramp 82 as a lever device to deflect cantilevered arm 72 until catch feature 74 has cleared shoulder 84, at which point seal 56 may be removed from vane end section 24.

It should be apparent to one skilled in the art that certain changes can be made to the above-described invention without departing from the broad, inventive concepts thereof. For example, the seals of the present invention in alternative embodiments can be configured to be used in connection with compressor vanes, fan vanes, and/or turbine nozzle vanes of gas turbine engines, steam turbine vanes, pump vanes, or in connection with any other variable area turbomachinery vane, or turbine. Furthermore, the profile of the seal and its receiving cavity may be altered while still retaining the novel aspects of the invention. Vane 20 may also optionally include a wide variety of additional features not shown herein. For example, a plurality of internal passages may be provided that extend through the interior of vane 20, ending in openings (not shown) in the trailing edge 28 of vane 20. A flow of cooling air may be directed through the internal passages, to remove heat from vane 20 and/or seal 56, if desired. In the present embodiment, vane 20 is made of a titanium alloy, although other materials may be used in other embodiments.

In addition, the present invention contemplates embodiments in which a vane end incorporates more than one seal guide feature, in which case the vane end seal may include a plurality of bodies and corresponding sealing portions. Also, different biasing members may be associated with each body/sealing surface, or a single biasing member may be employed.

The present invention also contemplates vane designs in which the vane portion extending beyond supporting members 32, 42 in the downstream direction (relative to the flow of working fluid) has a counterpart in the upstream direction. In such a design, vane end sections 24 and 26 may also have counterparts in the upstream direction forming additional gaps that can be sealed using seals provided in accordance with the present invention. As a skilled artisan will readily understand, some embodiments of the present invention may be employed advantageous use wherever a rotatable vane end and adjacent structures form a gap therebetween.

In one form, the present invention provides a rotatable vane assembly with a self-adjusting seal for sealing the gap between vane ends and the adjacent structure of the turbomachinery device. In one form, the assembly includes a vane configured to control the flow a working fluid in a turbomachinery device. In one form, one or more end sections of the vane, i.e., at the tip and/or root of the vane, include a seal guide feature that guides and pilots the seal. The seal may have a body that is slidably received by the guide feature, and may also have a sealing portion that seals against the surface of adjacent structures of the turbomachinery device into which the rotatable vane is installed. The seal body may be extendable from the vane's end section toward the surface of the adjacent structure in order to accommodate wear, and to seal between the vane end section and the surface despite possible changes in the gap width due to variations in the geometry of the surface of the adjacent structure, build tolerances, operational deflections, and thermal expansion. A biasing member, such as a compression spring, may bias the seal toward the surface of the adjacent structure.

Although embodiments described herein employ a seal guide feature in the form of a cavity that receives therein part of the body of the seal, it will be appreciated by those skilled in the art that other configurations may be employed without departing from the scope of the present invention. For example, one or more posts may be provided at the end sections of the vane, and a seal body may be slidably received over the one or more posts to thereby guide the seal body.

Embodiments of the present invention include a vane assembly for a turbomachinery device, the vane assembly comprising: a rotatable vane configured to control a flow of a working fluid in the turbomachinery device, the rotatable vane having at least one end section configured to be spaced apart from a surface of an adjacent structure of the turbomachinery device opposite the at least one end section to thereby leave a gap between the at least one end section and the surface, the at least one end section including a seal guide feature; a seal configured to seal the gap between the at least one end section and the surface, the seal including a body having a sealing portion, the body being configured to be slidably received by the seal guide feature at the at least one end section, and the sealing portion being configured to seal against the surface of the adjacent structure; and a biasing member configured to urge the sealing portion in a direction toward the surface.

In a refinement, the vane assembly further comprises a retention feature configured to releasably retain the body with the seal guide feature.

In another refinement, the seal guide feature includes a cavity in the at least one end section, wherein: the retention feature includes a cantilever latch arm having a first end, a second end opposite the first end, and a catch feature, the first end being attached to the body, and the catch feature being positioned on the second end; and the seal guide feature further includes a recess configured to receive the catch feature.

In yet another refinement, the catch feature is configured for movement within the recess; and the recess defines a shoulder positioned to engage the catch feature to thereby limit the extent of outward movement of the body from the cavity beyond a predetermined limit.

In still another refinement, the biasing member is a compression spring.

In yet still another refinement, the body includes a first pilot feature configured to pilot a first end of the spring, and wherein the seal guide feature includes a second pilot feature configured to pilot a second end of the spring.

In a further refinement, the seal guide feature includes a cavity in the at least one end section; wherein the cavity has an opening that faces the surface; and wherein the cavity defines a pilot feature for piloting the body.

In a yet further refinement, the sealing portion employs a low friction polymer.

Embodiments of the present invention include a vane assembly for a turbomachinery device, the assembly comprising: a rotatable vane configured to control a flow of a working fluid in the turbomachinery device, the rotatable vane having at least one end section configured to be spaced apart from a surface of an adjacent structure of the turbomachinery device that is opposite the at least one end section to thereby leave a gap between the at least one end section and the surface; means for sealing the gap between the at least one end section and the surface; and means for biasing the means for sealing toward the surface.

In a refinement, the means for sealing employs a low friction polymer.

In another refinement, the at least one end section defines a cavity configured to receive at least a part of the means for sealing; wherein the means for sealing includes both a body configured to reside in the cavity and means for contacting the surface; and wherein the cavity is configured to receive the body.

In yet another refinement, the means for sealing further includes means for retaining at least a part of the means for sealing in the cavity; wherein the cavity includes means for cooperating with the means for retaining to retain the means for sealing.

In still another refinement, the means for retaining includes a cantilever latch arm having a catch feature; wherein the means for cooperating includes a recess configured to receive and retain the catch feature.

In yet still another refinement, the catch feature is configured for movement within the recess; wherein the recess defines a shoulder positioned to engage the catch feature to thereby limit the extent of outward movement of the means for sealing from the cavity beyond a predetermined limit.

In a further refinement, the means for biasing is a compression spring; wherein the body defines a first pilot hole configured to pilot a first end of the spring.

In a yet further refinement, a second pilot hole configured to pilot a second end of the spring is formed in the cavity.

In a yet still further refinement, the means for biasing is a compression spring.

Embodiments of the present invention include a seal assembly for a rotatable vane of a turbomachinery device, comprising: a seal body configured to be movably received in a cavity formed in an end section of the rotatable vane, wherein the seal body includes a sealing portion configured to seal against a surface of a structure of the turbomachinery device that is adjacent to the rotatable vane, and the seal body being configured to span a variable gap between the end section and the surface of the adjacent structure.

In a refinement, the seal assembly further comprises a biasing member configured to urge the seal body in a direction toward the surface of the adjacent structure.

In another refinement, the biasing member is a compression spring.

In yet another refinement, the seal body defines a pilot feature for piloting an end of the spring.

In still another refinement, the seal assembly further comprises a retention feature configured to retain at least a part of the seal body in the cavity.

In yet still another refinement, the retention feature includes a cantilever latch arm having a first end, a second end opposite the first end, and a catch feature, wherein the first end is attached to the body; wherein the catch feature is positioned on the second end; and wherein the cavity includes a recess configured to receive the catch feature.

In a further refinement, the catch feature is configured for movement within the recess; and the recess defines a shoulder positioned to engage the catch feature to thereby limit the extent of outward movement of the body from the cavity beyond a predetermined limit.

In a yet further refinement, the sealing portion employs a low friction polymer.

Embodiments of the present invention include a turbomachinery device, comprising: a vane assembly, the vane assembly including: a rotatable vane configured to control a flow of a working fluid in the turbomachinery device, the rotatable vane having at least one end section configured to be spaced apart from a surface of an adjacent structure of the turbomachinery device opposite the at least one end section to thereby leave a gap between the at least one end section and the surface, the at least one end section including a seal guide feature; a seal configured to seal the gap between the at least one end section and the surface, the seal including a body having a sealing portion, the body being configured to be slidably received by the seal guide feature at the at least one end section, and the sealing portion being configured to seal against the surface of the adjacent structure; and a biasing member configured to urge the sealing portion in a direction toward the surface.

While the invention has been described in connection with what is presently considered to be the most practical and preferred embodiment, it is to be understood that the invention is not to be limited to the disclosed embodiments, but on the contrary, is intended to cover various modifications and equivalent arrangements included within the spirit and scope of the appended claims, which scope is to be accorded the broadest interpretation so as to encompass all such modifications and equivalent structures as permitted under the law. Furthermore it should be understood that while the use of the word preferable, preferably, or preferred in the description above indicates that feature so described may be more desirable, it nonetheless may not be necessary and any embodiment lacking the same may be contemplated as within the scope of the invention, that scope being defined by the claims that follow. In reading the claims it is intended that when words such as "a," "an," "at least one" and "at least a portion" are used, there is no intention to limit the claim to only one item unless specifically stated to the contrary in the claim. Further, when the language "at least a portion" and/or "a portion" is used the item may include a portion and/or the entire item unless specifically stated to the contrary.

What is claimed is:

1. A vane assembly for a turbomachinery device, the vane assembly comprising:

a rotatable vane configured to control a flow of a working fluid in said turbomachinery device, said rotatable vane having at least one end section configured to be spaced apart from a surface of an adjacent structure of the turbomachinery device opposite said at least one end section to thereby leave a gap between said at least one end section and the surface, said at least one end section including a seal guide feature;

a seal configured to seal the gap between said at least one end section and the surface, said seal including a body having a sealing portion, said body being configured to be slidably received by said seal guide feature at said at least one end section, and said sealing portion being configured to seal against the surface of the adjacent structure; and a biasing member configured to urge said sealing portion in a direction toward the surface.

2. The vane assembly of claim 1, further comprising a retention feature configured to releasably retain said body with said seal guide feature.

3. The vane assembly of claim 2, wherein said seal guide feature includes a cavity in said at least one end section, wherein:

said retention feature includes a cantilever latch arm having a first end, a second end opposite said first end, and a catch feature, said first end being attached to said body, and said catch feature being positioned on said second end; and said seal guide feature further includes a recess configured to receive said catch feature.

4. The vane assembly of claim 3, wherein:

said catch feature is configured for movement within said recess; and said recess defines a shoulder positioned to engage said catch feature to thereby limit the extent of outward movement of said body from said cavity beyond a predetermined limit.

5. The vane assembly of claim 1, wherein said biasing member is a compression spring.

6. The vane assembly of claim 5, wherein said body includes a first pilot feature configured to pilot a first end of said spring, and wherein said seal guide feature includes a second pilot feature configured to pilot a second end of said spring.

7. The vane assembly of claim 1, wherein said seal guide feature includes a cavity in said at least one end section; wherein said cavity has an opening that faces said surface; and wherein said cavity defines a pilot feature for piloting said body.

8. The vane assembly of claim 1, wherein said sealing portion employs a low friction polymer.

9. A vane assembly for a turbomachinery device, the assembly comprising:

a rotatable vane configured to control a flow of a working fluid in the turbomachinery device, said rotatable vane having at least one end section configured to be spaced apart from a surface of an adjacent structure of the turbomachinery device that is opposite said at least one end section to thereby leave a gap between said at least one end section and said surface;

means for sealing the gap between said at least one end section and the surface; and means for biasing said means for sealing toward the surface.

10. The vane assembly of claim 9, wherein the means for sealing employs a low friction polymer.

11. The vane assembly of claim 9, wherein said at least one end section defines a cavity configured to receive at least a part of said means for sealing; wherein said means for sealing includes both a body configured to reside in said cavity and means for contacting said surface; and wherein said cavity is configured to receive said body.

12. The vane assembly of claim 11, wherein said means for sealing further includes means for retaining at least a part of said means for sealing in said cavity; and wherein said cavity includes means for cooperating with said means for retaining to retain said means for sealing.

13. The vane assembly of claim 12, wherein said means for retaining includes a cantilever latch arm having a catch feature; and wherein said means for cooperating includes a recess configured to receive and retain said catch feature.

14. The vane assembly of claim 13, wherein said catch feature is configured for movement within said recess; and wherein said recess defines a shoulder positioned to engage said catch feature to thereby limit the extent of outward movement of said means for sealing from said cavity beyond a predetermined limit.

15. The vane assembly of claim 11, wherein said means for biasing is a compression spring; and wherein said body defines a first pilot hole configured to pilot a first end of said spring.

16. The vane assembly of claim 15, wherein a second pilot hole configured to pilot a second end of said spring is formed in said cavity.

17. The vane assembly of claim 9, wherein said means for biasing is a compression spring.

18. A seal assembly for a rotatable vane of a turbomachinery device, comprising:

a seal body configured to be movably received in a cavity formed in an end section of the rotatable vane;

a biasing member configured to urge said seal body in a direction toward a surface of a structure of the turbomachinery device that is adjacent to the rotatable vane, wherein said seal body includes a sealing portion configured to seal against the surface of the structure adjacent to the rotatable vane, and said seal body being configured to span a variable gap between said end section and the surface of the adjacent structure.

19. The seal assembly of claim 18, wherein said biasing member is a compression spring.

20. The seal assembly of claim 19, wherein said seal body defines a pilot feature for piloting an end of said spring.

21. The seal assembly of claim 18, further comprising a retention feature configured to retain at least a part of said seal body in the cavity.

22. The seal assembly of claim 21, wherein said retention feature includes a cantilever latch arm having a first end, a second end opposite said first end, and a catch feature, wherein said first end is attached to said body; wherein said catch feature is positioned on said second end; and wherein said cavity includes a recess configured to receive said catch feature.

23. The seal assembly of claim 22, wherein said catch feature is configured for movement within said recess; and wherein said recess defines a shoulder positioned to engage said catch feature to thereby limit the extent of outward movement of said body from said cavity beyond a predetermined limit.

24. The seal assembly of claim 18, wherein said sealing portion employs a low friction polymer.

25. A turbomachinery device, comprising:

a vane assembly, the vane assembly including:

a rotatable vane configured to control a flow of a working fluid in said turbomachinery device, said rotatable vane having at least one end section configured to be spaced apart from a surface of an adjacent structure of the turbomachinery device opposite said at least one end section to thereby leave a gap between said at least one end section and the surface, said at least one end section including a seal guide feature;

a seal configured to seal the gap between said at least one end section and the surface, said seal including a body having a sealing portion, said body being configured to be slidably received by said seal guide feature at said at least one end section, and said sealing portion being configured to seal against the surface of the adjacent structure; and a biasing member configured to urge said sealing portion in a direction toward the surface.

* * * * *